US006397915B1

(12) United States Patent
Amaranti et al.

(10) Patent No.: US 6,397,915 B1
(45) Date of Patent: Jun. 4, 2002

(54) APPARATUS FOR SUPPLYING THE SEALING FILM FOR A BLISTER BAND

(75) Inventors: Alessandro Amaranti, Castel S. Pietro Terme; Alessandro Alessandri, Funo di Argelato, both of (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 09/381,346

(22) PCT Filed: Mar. 16, 1998

(86) PCT No.: PCT/IB98/00376

§ 371 (c)(1),
(2), (4) Date: Sep. 27, 1999

(87) PCT Pub. No.: WO98/41464

PCT Pub. Date: Sep. 24, 1998

(30) Foreign Application Priority Data

Mar. 18, 1997 (IT) ..... BO97A0155

(51) Int. Cl.[7] ..... B65H 21/00

(52) U.S. Cl. ..... 156/504; 156/157; 156/502; 242/552; 242/555.5

(58) Field of Search ..... 156/157, 502, 156/504, 507; 242/551, 552, 555.3, 555.5, 556.1

(56) References Cited

U.S. PATENT DOCUMENTS 5,323,178 A 6/1994 Mohnkern et al.
5,474,252 A * 12/1995 Schmid ..... 156/159 X
6,192,955 B1 * 2/2001 Rice ..... 156/351

FOREIGN PATENT DOCUMENTS

| | | |
|---|---|---|
| EP | 0 142 794 A2 | 5/1985 |
| EP | 0 378 874 A1 | 12/1989 |
| EP | 0 539 983 A1 | 10/1992 |
| GB | 534445 | 3/1941 |
| JP | 59078060 | 4/1984 |

* cited by examiner

*Primary Examiner*—Mark A. Osele
(74) *Attorney, Agent, or Firm*—William J. Sapone; Coleman Sudol Sapone P.C.

(57) ABSTRACT

An apparatus for supplying sealing film for a blister band to a splicing station (10) includes a stepwise rotating drum (8) on which reel carriers (7) are mounted for receiving reels (6,6*s*,6*a*) of films (1,1*s*,1*a*). A pair of holding-driving rollers (16,17) are located close to each of carriers (7) to hold the film (1*a*) and to feed the film to the splicing device (10). The rollers (16,17) are operated by a retractable shaft (32), which engages the pair of rollers (16,17) situated in the region of the splicing device (10). A plate (5) keeps apart the film (1*a*) unrolled from a replacement reel (6*a*) from the film (1*s*) coming from a running out reel (6*s*). The plate (5) can be shifted crosswise with respect to the film unrolling direction, so as to allow the in-wait-state film (6*a*) to move to the unrolling position (S) after the splicing. The drum is rotated around a vertical axis to allow replacement of the empty reels, while cross-wise adjustments are automatically performed to match the transverse position of the sealing film and blister band after a size change-over. Lateral offset of the sealing film is automatically controlled by sensors (51,52) during operation.

14 Claims, 4 Drawing Sheets

FIG. 6
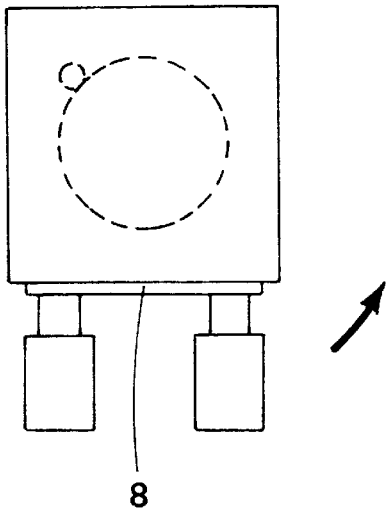
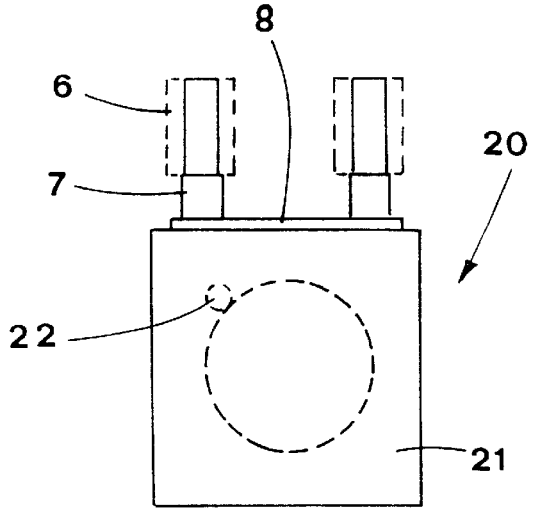
FIG. 7
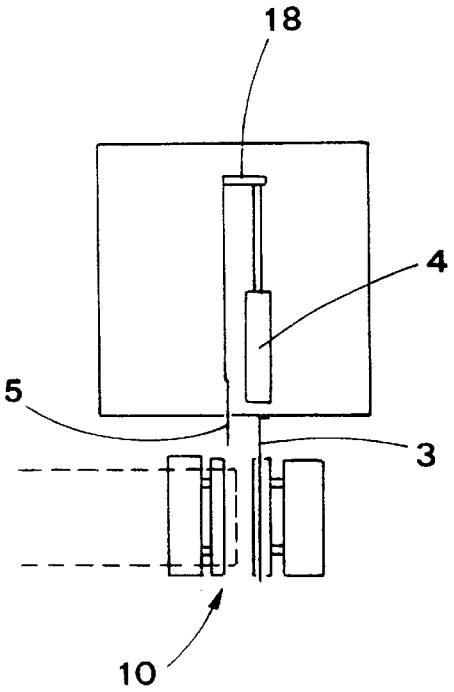
FIG. 4
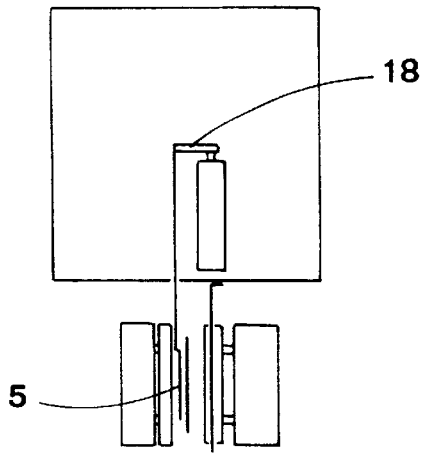
FIG. 5

APPARATUS FOR SUPPLYING THE SEALING FILM FOR A BLISTER BAND

BACKGROUND OF THE INVENTION

The present invention relates to the manufacture of automatic machines for packaging different kinds of articles in pieces of sealed blister band, commonly called blister packs. In particular, these articles of different kinds include pharmaceuticals such as capsules, tablets, pills and so on.

DESCRIPTION OF THE PRIOR ART

There are known machines for making blisters in a heat-formable band which are then filled with the articles being packed, sealed and then severed into blister packs.

The blister band, after filling, is driven through a station for checking the presence of the articles in the blisters (this station being possibly equipped also with means capable of detecting the integrity of the articles), a station in which an aluminium sealing film is applied to the side of the blister band in which the blisters are open, a severing station in which the blister band already sealed is cut in single blister packs.

In the sealing film applying station, the aluminium film is unrolled from a reel located nearby. Recently, automatic packaging machines have been designed with the possibility of carrying a plurality of aluminium film reels. The reels are set before starting the machine and then automatically spliced during operation, each one to the previous one being running out.

For these machines, there is the need to perform a size change-over, that means adjusting all the operative units to different sizes of the blister packs being produced, in a time as short as possible. It is also preferable to decrease the number of operators necessary to perform the change-over operation, however keeping the time necessary as short as possible.

Machines and methods known so far require, on the contrary, long time operations to release the operative units, that are fastened to the related carriers joined to the machine frame, to replace and/or adjust the position of the operative units, and lastly to lock again the units.

In particular, it is necessary to centre the sealing film supply device with respect to the blister band to be sealed. The centring operation is to be performed each time the width of the blister band changes.

The only two possibilities, therefore, include either having more people make the change-over/adjustment or planning a longer time before restoring normal operation.

Also replacement of the running out reels of film requires an operator, and therefore it increases the production costs of the whole machine. In particular, this is a big problem when, due to unavoidably short duration of the reels, the operator has to intervene each time that a reel is becoming empty to replace it with a full reel, before the reel is actually empty.

An example of a structure similar to the one used to solve the above mentioned problem of the packaging machines, can be found in the publication EP-A-0378874, which relates to a method for feeding band material to a copying machine.

The method is carried out by a machine equipped with a rotating drum with situated thereon four reels of band of different sizes. When it is necessary to change the size of the material to be supplied, the drum is rotated until the desired reel is brought near the taking out station. The drum carries also, near each reel, two motorised rollers, between which the band material ready to be taken is situated.

The publication DE-A-3933214 relates to a packaging machine provided with more film reels.

For each film reel there are two rollers, one of which driven by motor means to convey the film, while the other pushes the film against the driven roller. The conveying rollers are in gear engagement.

According to the publication GB-A-2135282, there is a star-like reel carrier for carrying three film reels.

Before the splicing operation, the replacement reel is moved from a first station to a second station, where a clip holding the beginning of the film is removed by a moving element and transferred to the splicing station.

When the reel in the third station is running out, the film is spliced with the film from the new reel in the splicing station. Then, the run out reel is brought back to the first station to be replaced.

SUMMARY OF THE INVENTION

An object of the present invention is to provide an apparatus that allows to perform size change over operations in extremely reduced time, without intervention of more than one operator.

Another object of the present invention is to allow repetitive replacement of the running out reel with a full reel without the operator's intervention after each splicing, so as to reduce time necessary for the preparation of the replacement reels at the beginning of each working turn, so that only one intervention, for starting the machine, by only one operator, is sufficient.

Further object of the present invention derives from what has been said above, i.e. to provide an apparatus that allows an easy and rapid substitution of run out reels with new reels, thus facilitating the operator's intervention.

Still further object of the present invention is to provide an apparatus that can be automatically set and adjusted in relation to the size of the blister band to be sealed, and consequently of the film, so that the operator does not have to perform long adjustment operations.

Finally, it is an object of the present invention to provide an apparatus capable to automatically control and correct the course of the film to be applied on the blister band to make up for its possible offset.

The above mentioned objects are obtained by means of an apparatus for supplying sealing film for a blister band to a splicing station including:

a drum rotating about a horizontal axle and featuring a plurality of carriers for receiving reels of films;

a station for splicing the film coming from a running out reel, situated in an unrolling position, with a film to be spliced coming from a new reel;

means for preparing the leader end of the film coming from the replacement reel in the region of the splicing station;

means allowing and determining a rotation of the drum about a vertical axis, means for automatic adjustment of the axial movement of the drum carrier axis upon the size change of the blister band to be closed with said film, and means for control and automatic adjustment of lateral offset of the sealing film.

Other constructive aspects of the subject apparatus are described in the sub-claims.

BRIEF DESCRIPTION OF THE DRAWINGS

The characteristics of the invention will be pointed out in the following, with particular reference to the enclosed drawings, in which:

FIGS. 4 and 5 show schematic plan views of a particular, which is fundamental for the apparatus operation, in two characteristic positions;

FIGS. 6 and 7 show schematic plan views of a particular, which is important for the apparatus operation, in two characteristic positions;

BEST MODE OF CARRYING OUT THE INVENTION

With reference to the previously described figures, the station supplying sealing film for a blister band includes a drum 8 rotating about a horizontal axis 41 and featuring, on its periphery, a plurality of carriers 7 for an equal number of reels 6,6*s*,6*a* of film 1*s*,1*a*.

Figure 8:
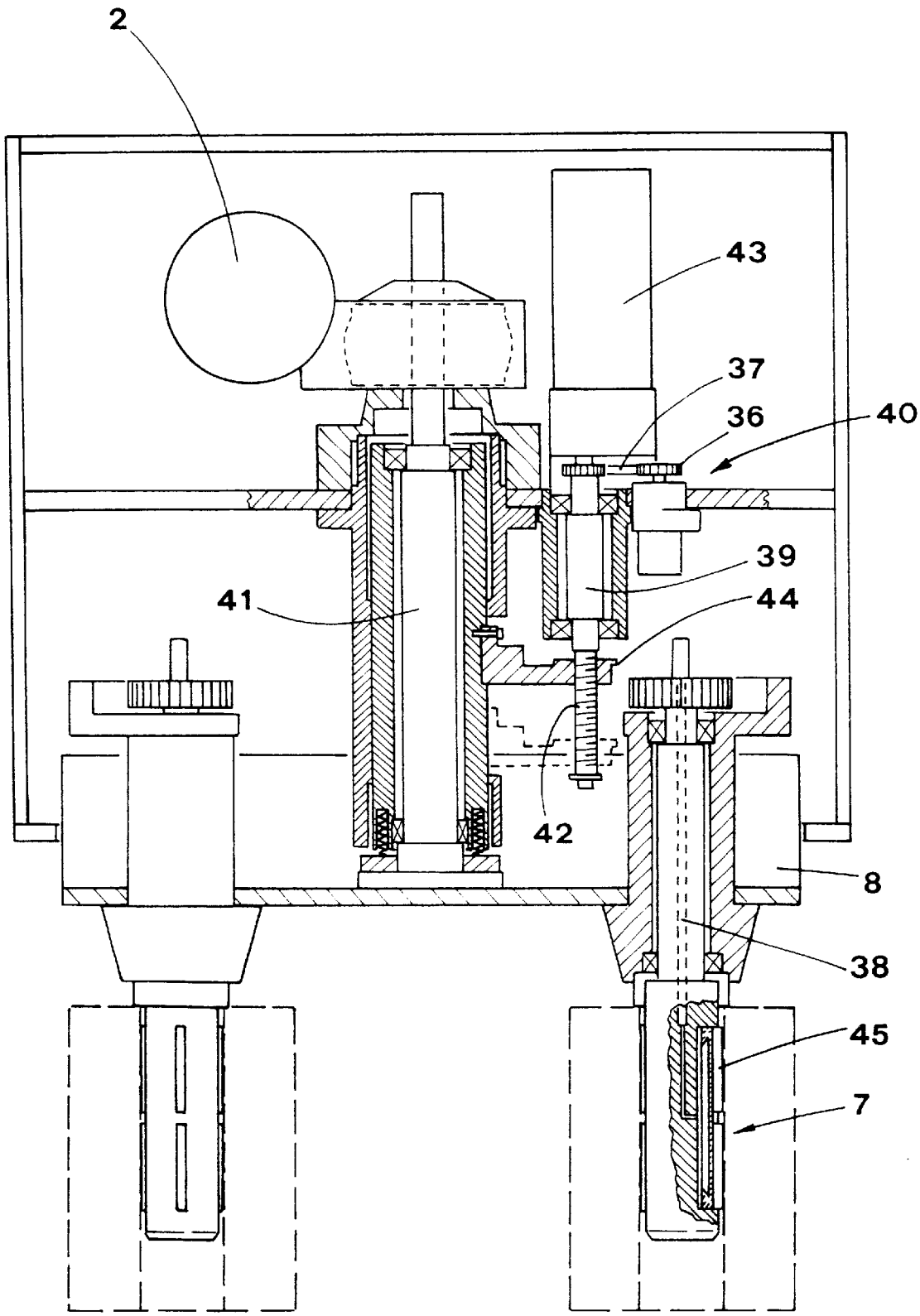
FIG. 8 shows a schematic section view of the station being the subject of the present invention, taken along a horizontal plane, with some parts removed for the clarity's sake.

As seen in FIG. 8, the carriers 7 include pneumatic expansion means 45 for locking respective reels 6. The pneumatic expansion means are supplied with in-pressure air in known way via a series of channels 38 only schematically shown in the figure. The channels 38 are arranged in the drum 8 in known way and are connected to a source of compressed air, not shown, with interposition of valve means.

The valve means, as well as all other elements listed later, which must work in mutual time relation, are controlled by an electronic control unit of known type and not shown in the figures.

Figures 1, 9:
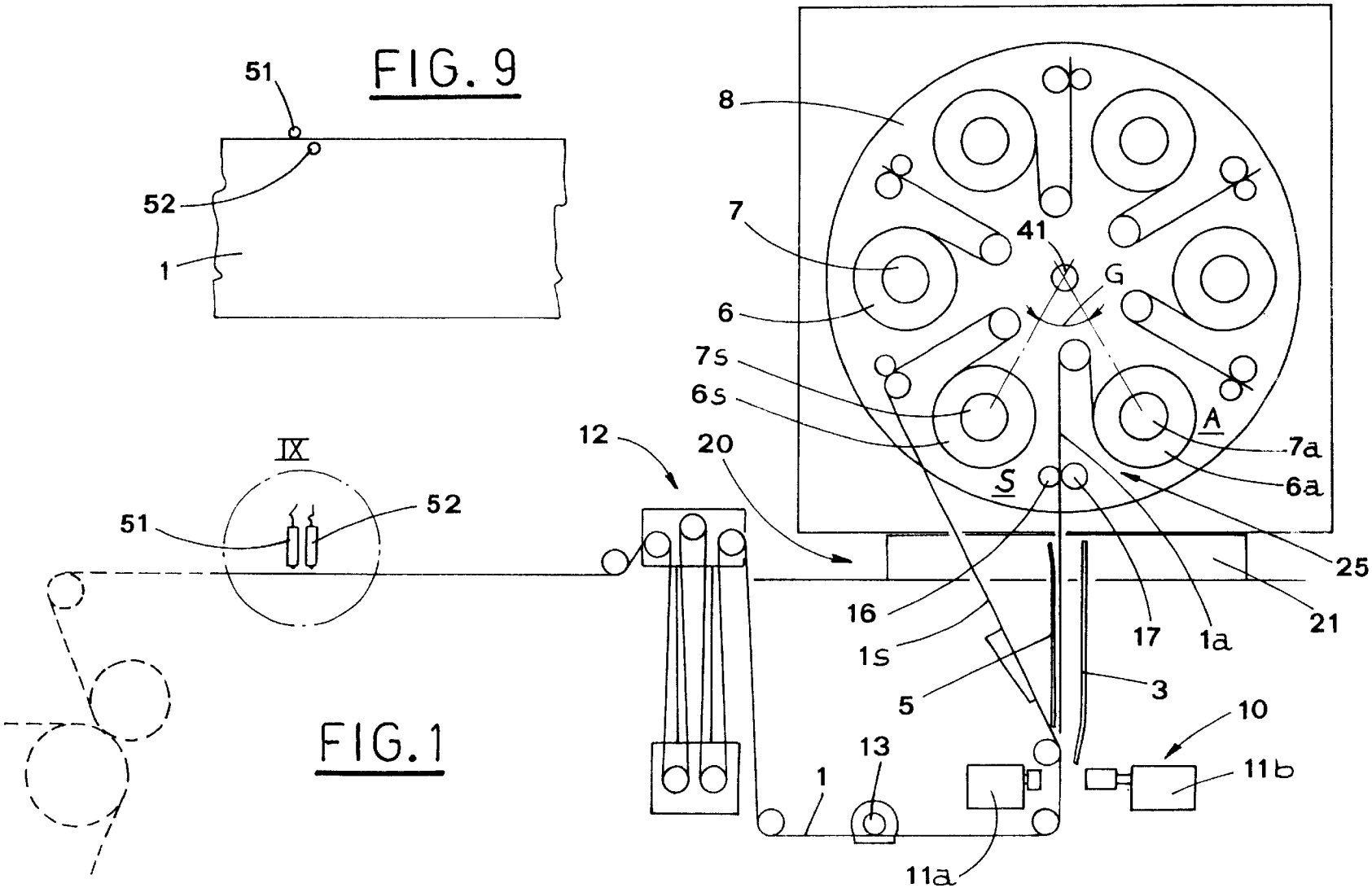
FIG. 1 shows a schematic lateral view of the apparatus being the subject of the present invention.
FIG. 9 shows a plan schematic view of fundamental parts of a particular IX of FIG. 1.

With reference to FIG. 1, motor means 2 of known type, seen in FIG. 8 drive the drum 8 into stepwise rotation by angle steps G corresponding to the angle included between the radiuses passing through two consecutive carriers 7*a*,7*s*.

The motor means 2 are operated by the control unit when the reel 6*s* is run out and the replacement film reel 6*a* starts to be used.

The station 10, where the film from a new reel is spliced with the trailer of the run out reel, is situated below the rotating drum and is of known type, e.g. heat-welding.

It is obvious that the characteristic features of the invention can be used, and therefore are equally protected, in apparatuses including other types of splicing stations, e.g. a station using adhesive tape.

The film 1 passing between the two welding elements 11*a*, 11*b*, is directed to the section where it is applied to the blister band, not shown as not related to the present invention (FIG. 1).

The film is comes from an unwinding reel 6*s*, situated in a position S, with reference to the drum 8 rotation direction, while the film 1*a*, which is to be spliced with the film 1*s*, comes from a replacement reel 6*a* situated in a waiting position A.

Before the splicing occurs, the means 25 are operated for bringing the leader end of the film la coming from the replacement reel 6*a* to the splicing station 10.

The means 25 moving the leader end of the film 1*a* include first of all a pair of holding-driving rollers 16,17 situated near each of the carriers 7 of the reels 6,6*s*,6*a*.

The rollers 16,17 hold the film before the respective reel 6 is brought near position A and then they drive the film, with the reel in the position A, until its leader is close to the splicing station 10.

The rollers 16,17 are operated by means 30, which act selectively only on the pair of rollers 16,17 situated in the position A.

Figure 3:
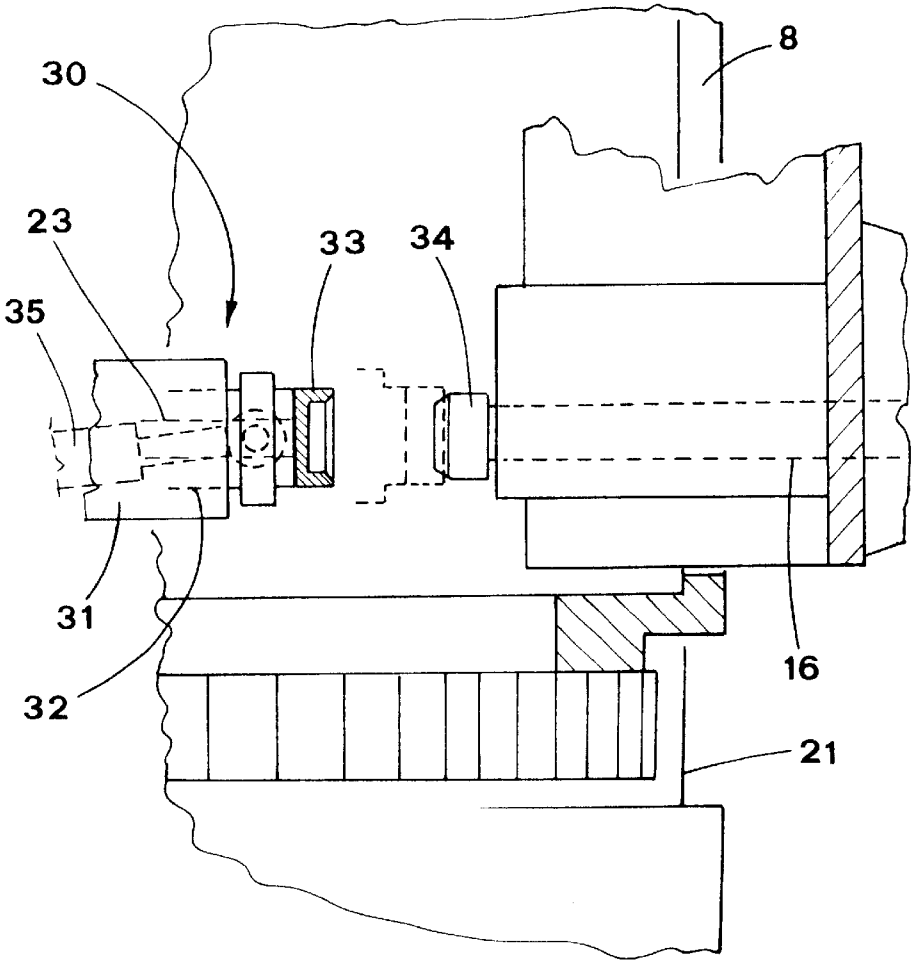
FIG. 3 shows the particular of the FIG. 2 in a section view taken along the line III—III.

With reference to FIG. 3, these operating means 30 include a horizontal supporting sleeve 31 situated behind the drum 8 and at level of the axis of the roller 16 related to the carrier 7 being in the waiting position A.

A sliding shaft 32, extending through the sleeve 31, is provided with a bevel-cup coupling 33 fastened to the free end of a rotating stem 23 carried inside the shaft 32 with possibility to turn.

The stem 23 is driven into rotation by motor means, not shown, coupled thereto, so as to transmit rotating movement and at the same time, allowing it to move longitudinally, according to known constructive techniques.

The inside of the bevel-cup coupling 33 has a truncated cone section, which can be set in friction engagement with a shank 34, having a complementary profile and being integral with one of the holding-driving rollers 16,17 of each pair.

The bevel-cup coupling 33 and the conical shank 34 can be joined due to the axial movement of the shaft 32 together with the stem 23, operated by actuator means 35.

The actuator means 35 include a horizontal pneumatic cylinder connected to the shaft 32 and operated with a suitable stroke.

In this way, joining between the bevel-cup coupling and the shank can always be correct, independently from the real distance between the rest position of the shaft 32 and the rear part of the drum 8, which, as will be described in the following, moves transversally, so as to adapt its position to the film width.

Each of the carriers 7 for the reels 6,6*s*,6*a* is equipped with means 46 detecting their rotation when the relative carrier takes the position S, in which the respective reel 6*s* unrolls.

Figure 2:
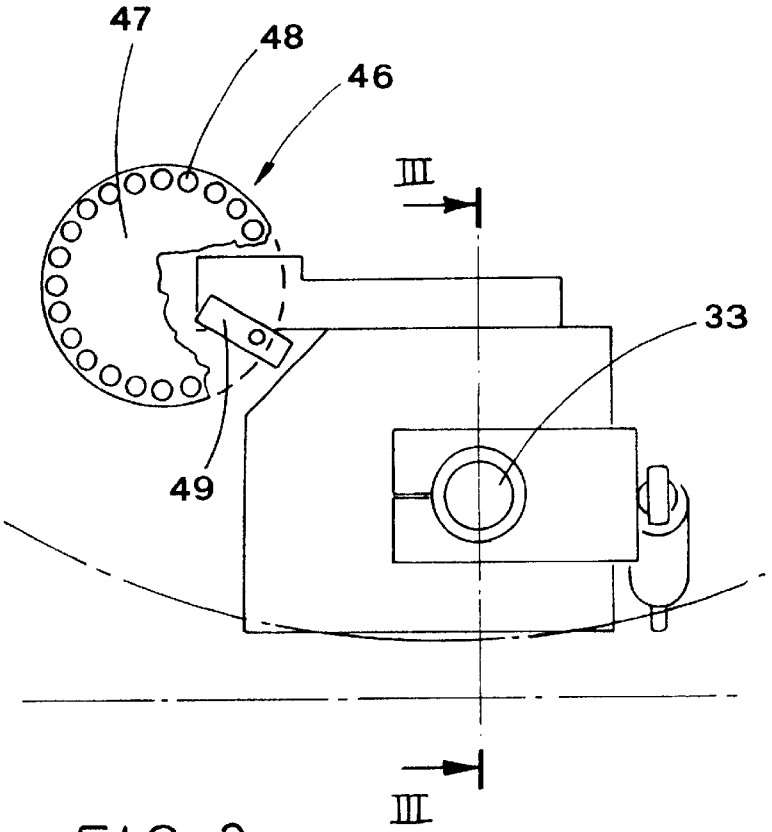
FIG. 2 shows a particular of the apparatus shown in FIG. 1 seen in detail.

As shown in FIG. 2, the rotation sensors 46 include a disc 47, keyed coaxial with a rear head of each of the carriers 7. The disc 47 features a plurality of holes 48 spaced along its periphery.

A sensor 49, connected to the electronic control unit, is situated in the region of the unrolling position S with its active end located along the area of the disc 47 passage.

In practice, when the waiting reel 6*a* is moved to the unrolling position S, the disc 47 is brought close to the sensor 49, which thus can detect the passage of the holes 48 in front of its active end during the carrier 7 rotation.

A plate 5 is provided for facilitating and guiding the convey of the film 1*a*. The plate 5 moves transversally to the film unrolling direction and separates the film 1*a* coming from the replacement reel 6*a*, situated in the position A, from the film ls coming from the running out reel 6*s*, situated in the unrolling position S (FIG. 1).

A stationary plate 3, parallel to the moving plate 5, is situated therebeside.

The terminal part of the waiting film la is situated between the moving plate 5 and the stationary plate 3.

After the splicing operation, the moving plate 5 must move, so as to allow the reel 6*a* to shift from the waiting position A to the unrolling position S, due to the stepwise rotation of the drum 8, controlled by the control unit.

As shown in FIGS. 4 and 5, the shifting plate 5 is moved by actuator means 4, formed e.g. by a pneumatic cylinder oriented horizontally and connected to the moving plate by a cross-bar 18.

The cylinder 4 determines the horizontal translation of the moving plate 5 in time relation with the drum 8 rotation to shift a reel 6*a* from the waiting position A to the unrolling position S.

The station, according to the invention, includes also means 20 allowing and determining the drum 8 rotation around a vertical axis, to facilitate the replacement of the run out reels with new reels, without any obstacle due to the presence of the other elements below.

With reference to FIGS. 6 and 7, these means 20 include a rotating platform 21 (FIG. 1), on which the drum 8 is mounted, controlled by the motor means 22 composed of a motor connected to the machine electronic control unit.

After a 180 degrees rotation of the drum 8, all the carriers 7 and the reels mounted thereon are easily accessible on the side opposite to the machine working side.

Means 40 are provided to avoid complex and time consuming adjustment operations of the drum 8 transversal position, and therefore also of the film 1 delivered by the reels 6 mounted on the carriers 7. These means 40 automatically adjust the axial movement of the drum carrier axis 41 (FIG. 8) and are operated after the size change of the blister band to be closed with the film 1.

The means 40 for automatic adjustment of the transversal movement include horizontal translation means 40 formed by a threaded bar 42 rotated axially by a motor 43 and engaged with an internal screw 44 made in the drum carrier axle 41.

Obviously, the motor 43 is connected to the electronic control unit and the axis 41 is moved by a distance determined by the control unit and checked by an encoder 36 in relation to the width of the film and the blister band.

The encoder 36 is linked by means of a belt 37 to the shaft 39 which drives the threaded bar 42.

After a rough adjustment, with the machine already started, a system of automatic adjustment of the lateral offset of the sealing film, is operated.

This system integrates with the already described horizontal translation means 40 and includes sensors 51,52 detecting the transversal offset of the film 1.

As seen in FIG. 9, the sensors 51,52, transversally staggered, are situated in the region where the film passes.

A sensor 52 is in more internal position and, in case of lacking of the film, it emits a signal, thus limiting the offset toward the film 1 central longitudinal axis.

The other sensor 51 is in more external position and, when it detects the presence of the film, it emits a signal, thus limiting the offset in direction opposite to the film 1 central longitudinal axis.

Finally, a storage unit 12 for storing the film 1 before splicing, is provided for allowing this slicing operation to be performed in due time.

The stored film is delivered during the splicing without interrupting the application of the film 1 on the blister band, due to stopping of the two films at the splicing station.

A sensor 13, of known type, is situated downstream of the splicing station 10 for detecting the presence of the film, and it can stop the machine if the film 1 breaks during the packaging process.

Operation of the station appears to be obvious from what just described.

Before resuming operation of the machine after working turn has changed, the operator commands the horizontal rotation of the drum 8, loading with extreme ease the full reels of film on the carriers 7, putting the edges of the films between respective holding-driving rollers 16,17.

After having brought the drum back to the previous position and performed the first splicing operation, the machine is started.

The moving plate shifts and the reel, from which the film is unrolled, is brought to the unrolling position S.

At the same time, a new reel is brought to the waiting position A and the holding-driving rollers 16,17 are activated until the film 1*a,* thus unrolling from the reel 6*a,* is just behind the splicing station 10.

The rollers 16,17 can be stopped by a sensor, not shown, that detects when the film edge reaches the desired area.

When the reel 6*s,* in the unrolling position S, is running out, the sensor 49 detects the carrier stopping and the control unit activates the splicing station 10, which blocks the film and welds it, while the storage unit delivers the stored film, thus avoiding any interruption of the packaging process.

At the same time the trailing end of the running out film is severed by a suitable device, not shown, as of known type.

Then, the splicing station 10 opens again, delivering the film 1 which restarts to run, thus feeding again the storage unit 12.

Immediately afterwards, the moving plate 5 shifts, so as to allow the passage of the film 1*a,* which translates due to the drum 8 rotation by one step, equal to angle G.

In this way, the reel 6*a* shifts to the unrolling position S, while a new reel 6 is brought to the waiting position A.

When the drum 8 rotation is finished, the moving plate 5 turns back to its normal working position and the holding-driving rollers 16,17 relative to the reel just put in the position A, are activated, so that the leader end of the new reel is repositioned to be ready for a new splicing.

The sensors 51,52 perform continuously an adjustment by acting on the motor 43 via the control unit, so as to move transversally the axle 41 of the drum 8, thus varying the film off-set from one side to the other.

Just after the size change over, the drum transversal position is determined automatically always by the motor 43, which moves transversally the supporting axle 41 of the drum 8.

It results from the above description that the apparatus being the object of the present invention fulfils all the objects specified in the introduction, allowing to perform the size change over in a limited time, by only one operator.

The running out reel is repetitively substituted with a full reel automatically after each splicing, thus allowing the operation of only one operator for the machine starting.

The run out reels can be easily substituted due to the 180 degrees rotation of the drum 8 carrier, thus facilitating the operator's intervention.

The apparatus is automatically arranged and adjusted in relation to the size of the blister band to be sealed, so that the operator does not have to perform long adjustment operations.

Moreover, the apparatus is able to automatically control and correct the path of the film to be applied on the blister band making up for possible off-sets.

It is understood that what above has been described as a mere, non limitative example, therefore possible constructive variants remain within the protective scope of the present technical solution, as described above and claimed in the following.

What is claimed is:

1. An apparatus for supplying sealing film for a blister band to a splicing station (10) comprising:

a drum (8) rotating about a horizontal axle (41) and having a plurality of carriers (7) arranged along its periphery for receiving reels (6,6*s*,6*a*) of films (1,1*s*, 1*a*);

a station (10) for splicing the film (1*s*) coming from a running out reel (6*s*), situated in an unrolling position (S), with a film to be spliced (1*a*) coming from a replacement reel (6*a*) situated in a waiting position (A);

means (25) for preparing a leader end of the film (1*a*) coming from the replacement reel (6*a*) in the region of the splicing station (10);

means (20) allowing and determining a rotation of the drum (8) about a vertical axis, means (40) for automatic adjustment of the axial movement of the drum carrier axis upon a size change of the blister band to be closed with said film (1), and means (40,51,52) for control and automatic adjustment of lateral offset of the sealing film;

said means (25) for preparing a leader end of the film (1*a*) including:

a pair of holding-driving rollers (16,17) located close to each of the carriers (7) for said reels (6,6*s*,6*a*) to hold the film (1*a*) before placing the respective reel in a waiting position (A) and to drag the film, with the reel in said waiting position (A), to the splicing device (10);

means (30) operating said holding-driving rollers (16, 17) and acting selectively on the pair of said holding-driving rollers (16,17) situated in said waiting position (A);

a plate (5), shifting transversely with respect to the film unrolling direction and aimed at keeping apart the film (1*a*) unrolled from the replacement reel (6*a*), situated in said waiting position (A), from the film (1*s*) coming from the running out reel (6*s*), situated in said unrolling position (S) before the splicing, and at shifting, so as to allow the replacement film (6*a*) to move from the waiting position (A) to an unrolling position (S) after the splicing, due to one step rotation of the drum (8).

2. An apparatus according to claim 1, characterized in that said operation means (30) include a horizontal carrier sleeve (31) situated behind the drum (8) and at the level of the carrier (7) being in the waiting position (A), a shaft (32), sliding inside the sleeve (31) and a stem (23), rotatably supported inside the shaft (32) and driven into axial rotation, said stem (23) being provided with a bevel-cup coupling (33) having a truncated cone section, and aimed at friction coupling with a shank (34), having a complementary profile and being integral with one of the holding-driving rollers (16,17), said coupling being a consequence of an axial shift of said shaft (32) and stem (23) operated by actuators (35).

3. An apparatus according to claim 2, characterized in that said actuators (35) include a pneumatic cylinder oriented horizontally and connected to said shaft (32).

4. An apparatus according to claim 1, characterized in that said plate (5) shifting transversely is controlled by actuating means (4) which determine a horizontal translation of said moving plate (5) in time relation with a rotation of the drum (8) imposed for moving the reel (6*a*) from the waiting position (A) to the unwinding position (S).

5. An apparatus according to claim 1, characterized in that said means (20) allowing and determining the rotation of said drum (8) about a vertical axis, include a rotating platform (21), on which the drum (8) is mounted, controlled by a motor means (22).

6. An apparatus according to claim 1, characterized in that said means (40) automatically adjusting the axial movement of the drum carrier axis (41) after size change of the blister band to be closed with the film (1), include horizontal translation means (40) acting on said drum carrier axis (41) supporting said drum (8).

7. An apparatus according to claim 6, characterized in that said horizontal translation means include a threaded bar (42), driven into axial rotation by a motor (43) and engaged with an internal screw (44) fastened to said drum carrier axis (41).

8. An apparatus according to claim 1, characterized in that said means for automatic making up for lateral offset of the sealing film with respect to the blister band, include horizontal translation means (40) acting on said drum carrier axis (41) supporting said drum (8) and sensor means (51,52) for detecting transverse shifting of the film (1).

9. An apparatus according to claim 8, characterized in that said horizontal translation means include a threaded bar (42), driven into axial rotation by a motor (43) and engaged with an internal screw (44) made in said drum carrier axle (41).

10. An apparatus according to claim 8, characterized in that said sensor means (51,52) include two sensors situated in the region where the film passes and being transversely staggered, a sensor (52) being in a more internal position aimed, in case of lacking of the film, at emitting a signal, thus limiting the off-set toward the film (1) central longitudinal axis, and a sensor (51) being in a more external position aimed, when it detects presence of the film, at emitting a signal, thus limiting the off-set in a direction opposite to the film (1) central longitudinal axis.

11. An apparatus according to claim 1, characterized in that each of said carriers (7) of the reels (6,6*s*,6*a*) is equipped with means (46) which allow to detect their rotation when the reels are located in the unrolling position (S), in which the respective reel (6*s*) unrolls.

12. An apparatus according to claim 11, characterized in that said rotation sensors (46) of said carriers (7) include a disc (47), keyed coaxial with a rear head of a respective carrier (7) and featuring a plurality of holes (48) spaced along its periphery, a sensor (49) situated in correspondence to said unrolling position (S), so as to be located beside said disc (47) to detect passage of the holes (48) in front of its active end during the carrier (7) rotation.

13. An apparatus according to claim 1, further comprising a storage unit (12) for storing said film (1), so as to allow splicing without interrupting application of the film on the blister band.

14. An apparatus according to claim 2, characterized in that said carriers (7) include pneumatic means (45) for locking respective reels (6).

* * * * *